United States Patent [19]

Hofer et al.

[11] 4,065,236

[45] Dec. 27, 1977

[54] FUEL INJECTION PUMP FOR AN INTERNAL COMBUSTION ENGINE

[75] Inventors: Gerald Hofer, Weissach-Flacht; Gunter Bofinger, Vaihingen, Enz; Heinz Nothdurft; Mohammad-Ali Khosrawi, both of Stuttgart; Helmut Simon, Goppingen; Karl Konrath, Ludwigsburg, all of Germany

[73] Assignee: Robert Bosch GmbH, Stuttgart, Germany

[21] Appl. No.: 623,383

[22] Filed: Oct. 17, 1975

[30] Foreign Application Priority Data

Oct. 17, 1974 Germany ..... 2449333

[51] Int. Cl.[2] ..... F04B 7/06; F02M 59/34

[52] U.S. Cl. ..... 417/493; 123/139 BD; 417/500

[58] Field of Search ..... 417/490, 493, 500; 123/139 BD

[56] References Cited

U.S. PATENT DOCUMENTS

| | | | |
|---|---|---|---|
| 2,478,528 | 8/1949 | Edwards | 123/139 BD |
| 2,965,087 | 12/1960 | Bischoff | 123/139 BD |
| 3,758,241 | 9/1973 | Eheim | 417/500 X |
| 3,945,360 | 3/1976 | Laufer | 123/139 BD |

*Primary Examiner*—William L. Freeh
*Assistant Examiner*—Leonard E. Smith
*Attorney, Agent, or Firm*—Edwin E. Greigg

[57] ABSTRACT

The pump piston in a fuel injection pump is provided with longitudinal grooves which provide communication between the pressure chamber and the fuel supply chamber. An annular groove on the pump piston connects the longitudinal grooves so that communication between the pressure chamber and the fuel supply chamber is interrupted only after onset of the axial pressure stroke regardless of prior piston rotation.

4 Claims, 3 Drawing Figures

FUEL INJECTION PUMP FOR AN INTERNAL COMBUSTION ENGINE

BACKGROUND OF THE INVENTION

The invention relates to a fuel injection pump for use in an internal combustion machine. The fuel injection pump includes a reciprocating and simultaneously rotating pump piston, serving as fuel distributor. The pump piston is provided at one end with longitudinal grooves that always communicate with the pressure chamber of the injection pump. During the rotation of the piston and during at least a portion of its suction stroke these grooves open suction channels partially extending in the injection pump cylinder and leading to the suction chamber of the fuel injection pump.

In order to insure proper filling of the pump pressure chamber during full-load and high r.p.m. engine operation, it is desired to maintain a long communication between the suction chamber and the pump pressure chamber during the suction stroke of the piston. For this purpose, the longitudinal grooves are made as wide as possible and, if possible, several longitudinal grooves are open simultaneously. However, the use of large control surfaces also requires a very precise shut-off so as to prevent different onset times of fuel delivery to the individual cylinders during the individual pressure strokes. In the known control process using longitudinal grooves, a considerable expense is required to obtain uniform shut-off of the suction channels during all fuel delivery strokes.

OBJECT AND SUMMARY OF THE INVENTION

It is a principal object of the invention to provide a fuel injection system of the above-described type in which the shut-off of the suction channel is uniform for all pressure strokes occurring during a rotation of the pump piston.

This object is attained according to the invention by providing a supplementary connection between the suction chamber and the pump pressure chamber. This supplementary connection is interrupted by control edges extending transversely to the pump axis and the interruption occurs after the onset of the pressure stroke of the piston. Thus the shut-off of the suction channels takes place finally by a purely stroke-dependent control process, whereas the longitudinal grooves themselves had already been separated from the suction channels near the end of the suction stroke by the rotational motion of the piston.

The invention will be better understood as well as further objects and advantages thereof will become more apparent from the following detailed description of two exemplary embodiments taken in conjunction with the drawing.

DESCRIPTION OF THE PREFERRED EMBODIMENTS

Figure 1:
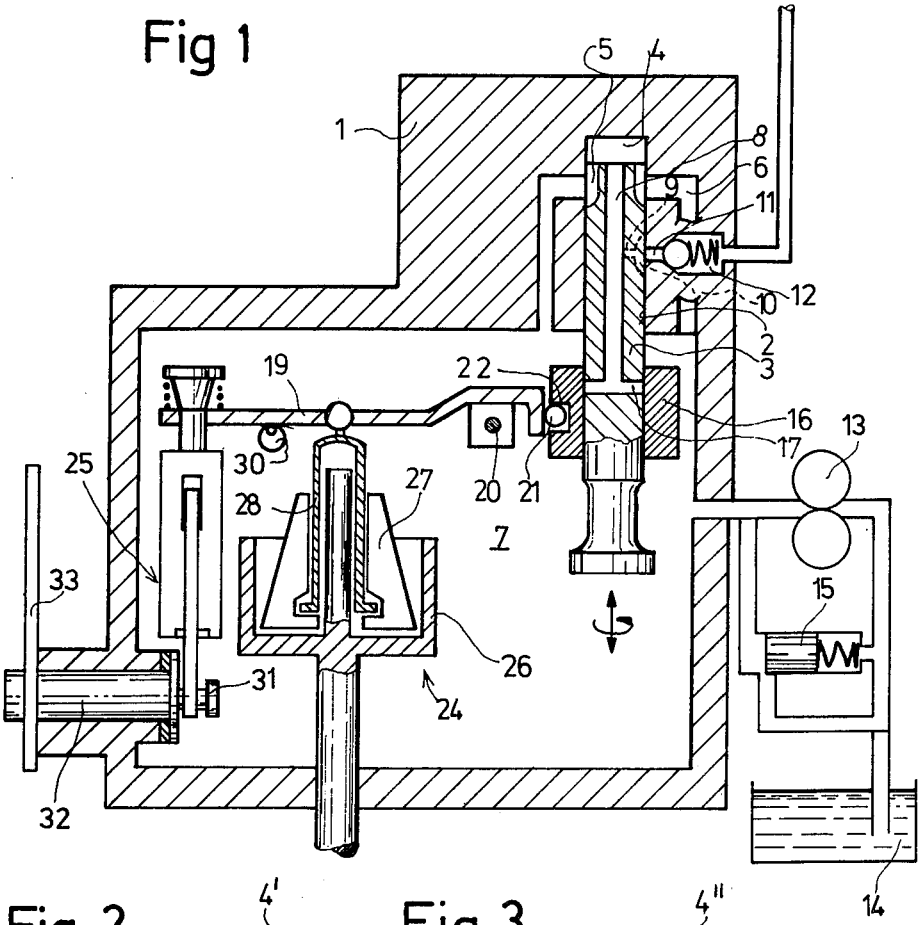
FIG. 1 is a partially sectional view of the entire fuel injection pump in a known configuration.

A housing 1, shown in simplified form, of a fuel injection pump includes a bore 2 within which moves a pump piston 3 which is set into simultaneously reciprocating and rotating motion by means not shown. The working or pressure chamber 4 of this pump is supplied with fuel from a suction chamber 7 via bores 6 extending within the housing 1 and longitudinal grooves 5 disposed in the circumference of the pump piston. The fuel flow from the suction chamber occurs as long as the pump piston executes its suction stroke, i.e., travels in the direction of its bottom dead center position. After the rotation of the pump piston 3 obturates the bores 6, fuel then present in the pump pressure chamber is delivered through a longitudinal channel 8 within the piston, a radial bore 9 and a distribution groove 10 located in the circumference of the pump piston to one of several pressure lines 11. The number of pressure lines corresponds to the number of engine cylinders and these lines are distributed around the circumference of the bore 2 and terminate therein. Each of these pressure lines includes a check valve 12 and leads to an injection valve, not shown, associated with one of the cylinders of the engine.

A fuel pump 13 delivers fuel from a fuel container 14 to the suction chamber 7. A fuel pressure control valve 15 so regulates the pressure in the suction chamber 7 that, in known manner, the pressure in the suction chamber increases with increasing r.p.m.

Disposed on the pump piston 3 is an annular slide 16 which, during the pressure stroke of the piston, opens a radial bore 17 communicating with the axial bore 8 and thus determines the amount of fuel delivered to a particular pressure line. Fuel flowing out of the pump pressure chamber after opening of the radial bore 17 flows back into the suction chamber 7.

The annular slide 16 is displaced by a control lever 19 pivotable about an axis 20. The control lever has a spherical head 21 engaging a recess 22 within the annular slide 16. The other end of the control lever is engaged by a centrifugal force governor 24 acting as r.p.m. sensor which acts in opposition to the force of a control spring mechanism 25 engaging the remote end of the control lever 19. The centrifugal force governor 24 includes a carrier 26 for flyweights 27 which are driven, together with the carrier, by means of a gear train, in a constant ratio to the r.p.m. of the pump piston. The centrifugal force displaces the flyweights 27 which, in turn, displace a coaxial sleeve 28 which engages the control lever 19 at a single point with an r.p.m.-dependent force.

The farther the annular slide 16 is displaced downwardly by the pivotal motion of the control lever 19, the smaller is the amount of fuel which the injection pump delivers to a pressure line 11 since the radial bore 17 is opened at a correspondingly earlier time during the delivery stroke of the pump piston and thus a larger portion of the fuel which could be delivered by the pump piston actually flows back to the suction chamber. The maximum amount of fuel is determined by the highest position of the annular slide 16 and this position is limited by an eccentric stop 30. The degree of downward displacement of the annular slide 16 at a particular r.p.m. depends on the force exerted by the control spring mechanism 25 on the control lever 19. This force is defined by an eccentric 31 located on a shaft 32 which is itself rotatable by a lever 33 which permits arbitrary actuation by the operator of the engine. The control spring mechanism 25 is suspended at one end on the eccentric 31.

Figure 2:
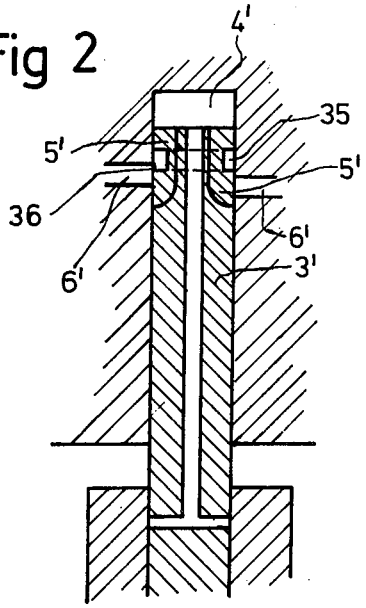
FIG. 2 is a section from FIG. 1 containing the modifications made in the fuel injection pump according to a first exemplary embodiment of the invention.

In the first exemplary embodiment of the invention according to FIG. 2, the pump piston 3' has an additional annular groove 35 whose communication with the fuel supply bore 6' is interrupted shortly after the onset of the pressure stroke of the pump piston 3'. This annular groove 35 which establishes a communication among the longitudinal grooves 5' still maintains communication with the suction bores 6' even after the longitudinal grooves 5' have already been separated from the suction bores 6'. Thus, at the beginning of the pressure stroke of the piston, there still remains a communication between the pump pressure chamber 4' and the suction bores 6'. When the annular groove 35 is finally separated from the suction bores 6' during the further pressure stroke, the fuel supply to the pressure lines 11 and to the engine begins. When several suction bores 6' are present, an exact onset of fuel delivery may be assured by displacing one of the suction bores 6' toward the pump pressure chamber so that only a single location 36 is actually responsible for the final shut-off of communication to the suction chamber at the beginning of the pressure stroke.

Figure 3:
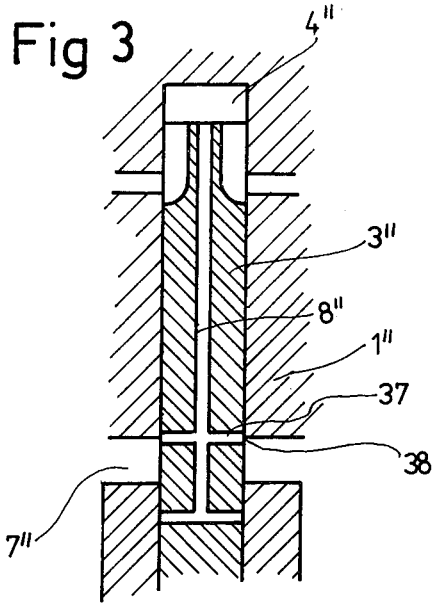
FIG. 3 is a section of FIG. 1 corresponding to a second exemplary embodiment of the invention.

The second exemplary embodiment illustrated in FIG. 3 includes a pump piston 3'' provided with a second transverse bore 37 which communicates with the longitudinal channel 8'' and which is obturated at the beginning of the pressure stroke by the control edge 38 in the pump housing 1''.

What is claimed is:

1. In a fuel injection pump which includes:

A. a housing within which are formed a fuel chamber, a cylindrical bore and at least one connecting channel between said chamber and said bore;

B. a pump piston, disposed to move rotatably and axially within said cylindrical bore and defining with said housing a pressure chamber as part of the cylindrical bore, said pump piston being provided with longitudinal grooves at one end thereof, each opening into the pressure chamber and each being capable of establishing and interrupting communication between said chamber and said cylindrical bore; the improvement comprising:

C. an annular fuel conduit formed in the pump piston to intersect each of the longitudinal grooves, said annular fuel conduit defining control edges extending transversely to the pump axis which control obturation of the annular fuel conduit during the axial excursion of the pump piston and after the onset of the pressure stroke of the piston.

2. A fuel injection pump as claimed in claim 1, wherein said fuel conduit is an annular groove in said pump piston which provides communication among said longitudinal grooves and which can maintain communication between said chamber and said bore when direct communication between said longitudinal grooves and said at least one connecting channel is interrupted.

3. A fuel injection pump as claimed in claim 2, wherein at least one of said connecting channels terminates in said bore at a point nearer to the closed end thereof than any of the remaining ones of said connecting channels.

4. In a fuel injection pump which includes:

A. a housing within which are formed a fuel chamber, a cylindrical bore and at least one connecting channel between said chamber and said bore;

B. a pump piston, disposed to move rotatably and axially within said cylindrical bore and provided with longitudinal grooves at one end thereof, capable of Pg,13 establishing and interrupting communication between said chamber and said cylindrical bore; the improvement comprising:

C. a fuel conduit between said chamber and said cylindrical bore, capable of being obturated during the axial excursion of said pump piston, wherein said fuel conduit is a transverse channel passing through said pump piston and wherein said pump piston has an axial channel communicating with said transverse channel and with said bore; whereby communication may be established from said chamber through said transverse channel and through said axial channel to said bore and communication may be obturated by the walls of said bore during the axial excursion of said pump piston.

* * * * *